US006270009B1

(12) United States Patent
Heeren

(10) Patent No.: US 6,270,009 B1
(45) Date of Patent: Aug. 7, 2001

(54) CARDBOARD BROADSHEET FOR CONSTRUCTING A STACKABLE BOX AND THE BOX RESULTING THEREFROM

(75) Inventor: Marinus Cornelis Maria Heeren, Hoogstraten-Minderhout (BE)

(73) Assignee: R & F Folding Boxes, Hoogstraten-Meer (BE)

( * ) Notice: Subject to any disclaimer, the term of this patent is extended or adjusted under 35 U.S.C. 154(b) by 0 days.

(21) Appl. No.: 09/506,497

(22) Filed: Feb. 18, 2000

(30) Foreign Application Priority Data

Sep. 16, 1999 (EP) ..... 99870188

(51) Int. Cl.[7] ..... B65D 5/42
(52) U.S. Cl. ..... 229/178; 229/918; 229/919
(58) Field of Search ..... 229/178, 191, 229/915, 918, 919

(56) References Cited

U.S. PATENT DOCUMENTS 3,102,674 * 9/1963 Hamilton ..... 229/178
3,973,723 * 8/1976 Owens ..... 229/178
4,266,714 * 5/1981 Crane ..... 229/915
4,770,339 * 9/1988 Weimer ..... 229/178
5,458,283 * 10/1995 Southwell et al. ..... 229/178
5,649,663 * 7/1997 Pestow, Jr. ..... 229/918
5,673,848 * 10/1997 Garza ..... 229/191

FOREIGN PATENT DOCUMENTS 0485032 5/1992 (EP) .
0575004 12/1993 (EP) .
1002381 8/1997 (NL) .

* cited by examiner

*Primary Examiner*—Gary E. Elkins
(74) *Attorney, Agent, or Firm*—Dykema Gossett PLLC

(57) ABSTRACT

The invention relates to a broadsheet for constructing a box consisting of a bottom and side walls, characterised in that two opposite edges of the bottom (1) are extended by a first transverse strip (3) and a second transverse strip (4) which is foldable with respect to the first transverse strip (3), whereby a) the first transverse strip (3) is extended along both its extremities by a wing which results in angular supports; b) the second transverse strip is extended along both sides of its central portion (13) by a wing consisting of parts (14 and 15) with a folding line (16) in between, resulting in glueing surfaces meant to be glued together with above said central portion and with above said first transverse strip.

6 Claims, 3 Drawing Sheets

CARDBOARD BROADSHEET FOR CONSTRUCTING A STACKABLE BOX AND THE BOX RESULTING THEREFROM

This invention relates to a cardboard broadsheet for constructing a stackable box with angular supports consisting of a bottom and four side walls.

It is the aim of the invention to design a broad-sheet from which a stackable box may be constructed showing a load bearing capacity that is unusual up to now. The invention also aims at designing the broadsheet such, that the mechanical construction of the box is carried out with technically extremely reliable means.

To make this possible in accordance with the invention, two opposite edges of the bottom are extended by a first transverse strip which is foldable with respect to the bottom of the box, and a second transverse strip which is foldable with respect to the first transverse strip, each time according to folding lines extending parallel to above said edges, whereby a) the first transverse strip is extended along both its extremities by a wing which results in angular supports by folding each wing according to several parallel lines extending perpendicularly to above said folding lines and resulting in small strips;

b) the second transverse strip is extended along both sides of its central portion by a wing consisting of parts with a folding line in between, resulting in glueing surfaces meant to be glued together, at the one hand with above said central portion, and at the other hand with above said first transverse strip.

Still according to the invention, in above said central portion of above said second transverse strip, a lip is cut out showing a folding line that coincides with above said folding line between the first and second transverse strips in order to be glued to this second transverse strip.

A further feature of the invention is to be found in the fact that, in above said wings resulting in above said angular supports, at the site of the folding line shown substantially in the middle of the angular support, a portion is provided which protrudes upwards when the box is ready for use.

Other advantages and features of the invention will show from the following description of a cardboard broadsheet for constructing a stackable box according to the invention. The reference numbers refer to the attached figures.

Figure 1:
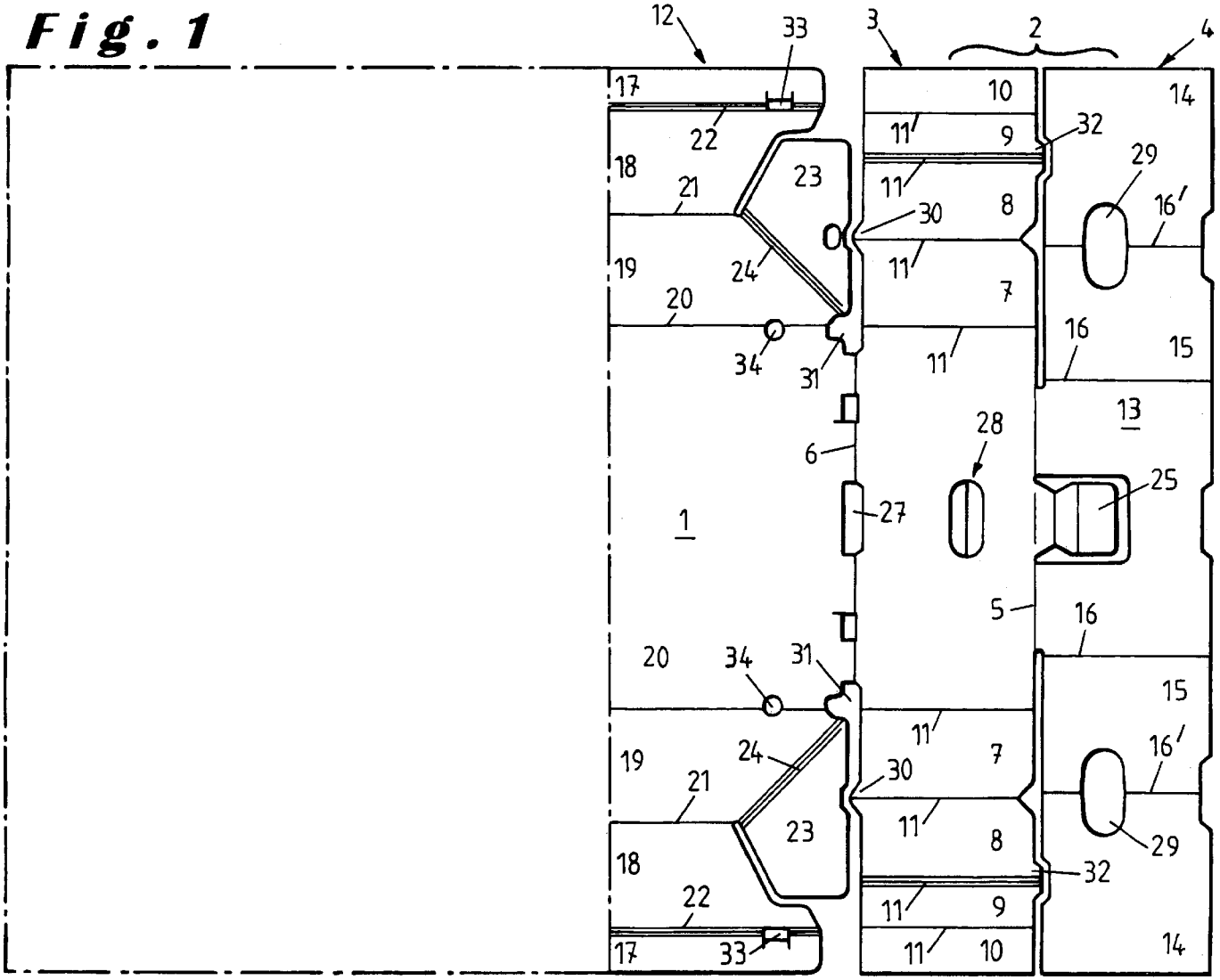
FIG. 1 is a top view (half representation according to the plane of symmetry) of the broadsheet according to the invention.

The broadsheet represented in FIG. 1 consists of a bottom 1 and four side walls 2 and 12. Although in principle the box could be square, the box described here shows a rectangular profile. The side walls 2 of the box, which in the frame of the invention play an essential role and will be considered as transverse walls, consist of a first transverse strip 3 and a second transverse strip 4 with a folding line 5 in between. A second folding line 6 extends between the first transverse strip 3 and the bottom 1.

Each extremity of the first transverse strip 3 is extended by a wing resulting in an angular support and comprising thereto a series of small strips 7, 8, 9 and 10, all of which are separated by folding lines 11. Two of these strips, i.e. the strips 7 and 10, are glued, the first, 7, to a portion of the side wall 12; the second, 10, to a part 14 of the transverse strip 4.

To make this possible, the second transverse strip 4, along both sides of its central portion 13, is subdivided into two parts 14 and 15, and this according to folding lines 16 and 16'.

A first glueing together occurs between the external side of the parts 14 and 15 (with the external side is meant that side of the broadsheet which is not visible in FIG. 1. The interior side is then, inversely, the side shown in FIG. 1). The second glueing together occurs between the interior side of the part 15 and that of the central portion 13. The next step is the glueing together of the interior side of the part 14 with the interior side of the transverse strip 3. In order to form the angular supports, it is proceeded as follows: The strip 10 is glued with its exterior side to the portion (at the exterior side) that remained free on the part 14 of the transverse strip 4 after glueing together this part with the part 15.

A portion of the strip 7 (exterior side) is glued onto a portion of the interior side of the wall 12. This wall 12 consists of three longitudinal strips 17, 18 and 19 with various folding lines 20, 21 and 22. The longitudinal strips 18 and 19 are glued together with their interior sides, after these longitudinal strips have been folded according to folding line 21. The longitudinal strip 17 is then glued with its interior side to the bottom 1 of the box, after this strip has been folded according to folding line 22. Obviously, this glueing together occurs after folding the longitudinal strips 19 according to folding line 20 and the longitudinal strips 18 according to folding line 21. Besides above said longitudinal strips 17, 18 and 19, the wall 12 also shows two header strips 23 which are linked, at the site of folding line 24, with the longitudinal strip 19.

Only a portion of the interior side of each of the header strips 23 is glued together with the corresponding portion of the exterior side of the strip 7 which is part of an angular support.

Figure 2:
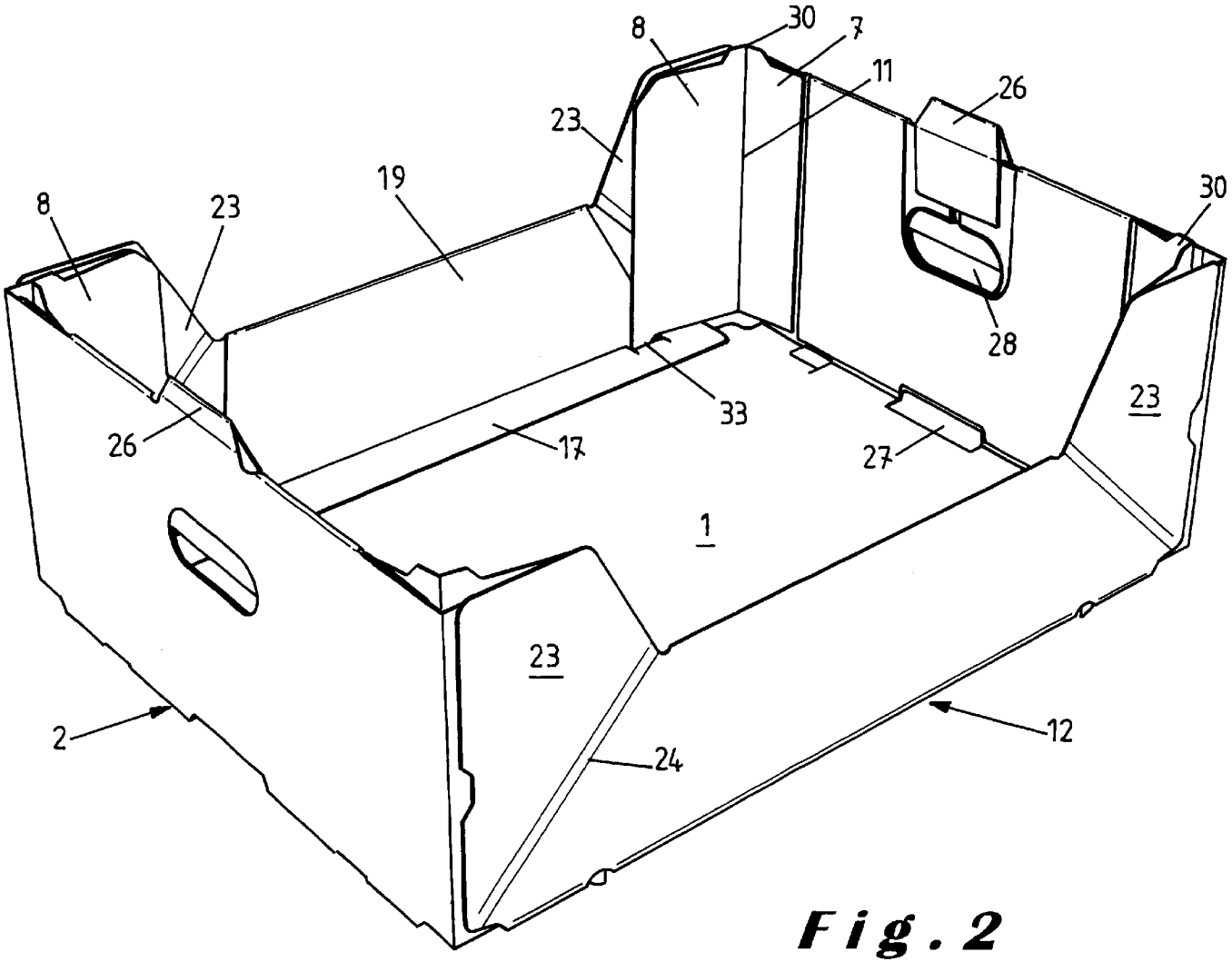
FIG. 2 is a perspective representation of the box constructed by means of the broadsheet according to FIG. 1.
Figure 3:
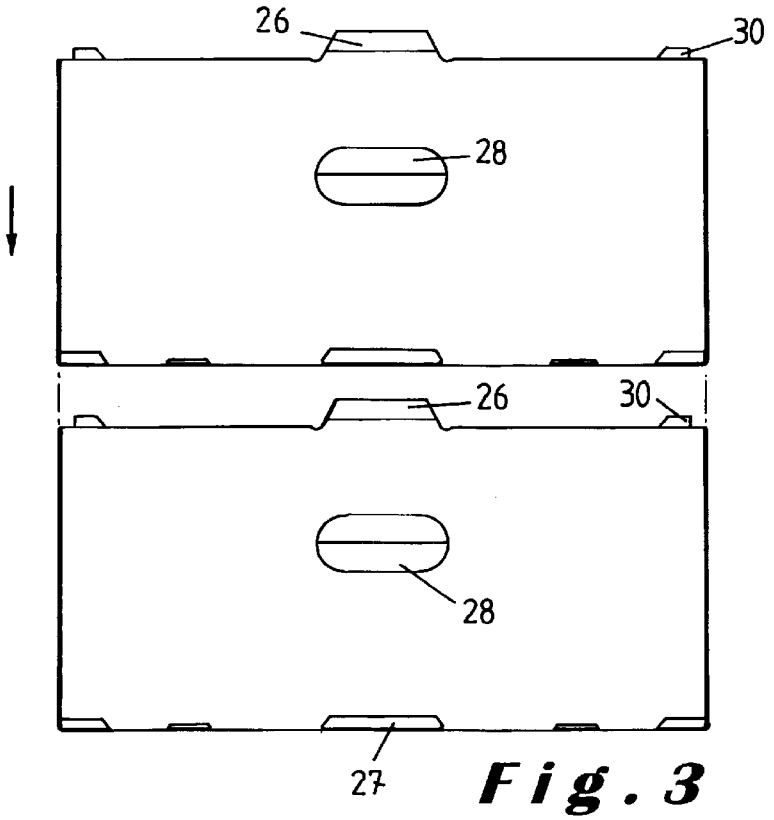
FIG. 3 is, on a reduced scale, a front view of two stackable boxes according to the invention.
Figure 4:
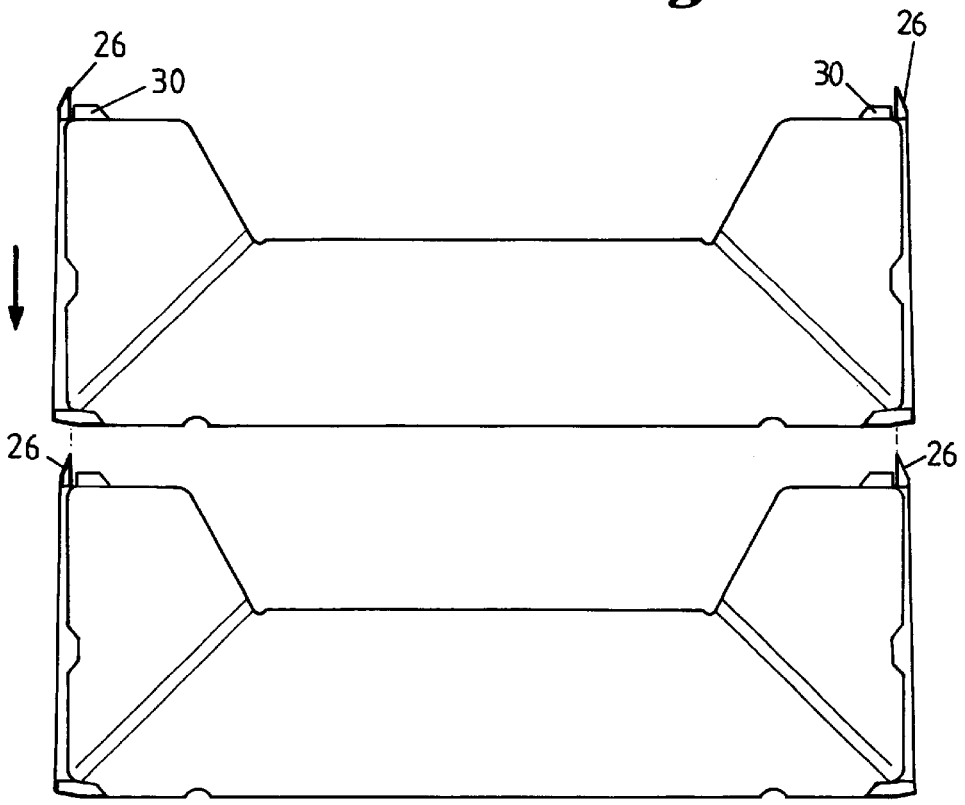
FIG. 4 is, on the same scale, a side view of two stackable boxes according to the invention.

The folding line 24 allows to fold the box by turning down the four walls thereof onto the bottom 1. Finally, it should also be remarked that the central portion 13 of the second transverse strip 4 shows a lip 25, which is foldable with respect to the first transverse strip 3 and is glued onto the interior side thereof to form a protrusion 26 (FIGS. 2–4), which when stacking two boxes, fits into an opening 27 provided at the height of the folding line 6, between the bottom 1 and the first transverse strip 3. An elongated opening 28 is further provided in the middle of the central portion 13 of the second transverse strip 4. When folding according to the folding line 5 the second transverse strip 4 with respect to the first transverse strip 3, a handle is created in conjunction with the elongated opening 29 (in the middle of the first transverse strip 3) to grab the box with one's fingers. It will also have been noted that the elongated openings 29, which are created between the extremities of the parts 14 and 15 facing each other when the box is finished, cooperate with the elongated openings 28.

At the height of a folding line 11 between two strips 7 and 8, a raised pointed protrusion 32 is provided, meant to cooperate, in the stacked position of two boxes, with a space 31 which is created at both extremities of the bottom 1, at the site where the folding line 20 crosses the folding line 6. At the bottom of each angular support, finally a similar raised pointed protrusion 30 is provided, meant to cooperate with an opening 33 at the edge of the bottom 1, at the height of the folding line 20, and an opening 34 at the folding line 20.

What is claimed is:

1. Cardboard broadsheet for constructing a stackable box with angular supports consisting of a bottom and four side walls, characterised in that two opposite edges of the bottom (1) are extended by a first transverse strip (3) which is foldable with respect to the bottom (1) of the box and a second transverse strip (4) which is foldable with respect to the first transverse strip (3), each time according to folding lines (5 and 6) extending parallel to above said edges, whereby a) the first transverse strip (3) is extended along both its extremities by a wing which results in angular supports by folding each wing according to several parallel lines (11) extending perpendicularly to above said folding lines and resulting in small strips (7–10);

b) the second transverse strip is extended along both sides of its central portion (13) by a wing consisting of parts (14 and 15) with a folding line (16) in between, resulting in glueing surfaces meant to be glued together, at the one hand with above said central portion, and at the other hand with above said first transverse strip.

2. Broadsheet according to claim 1, characterised in that, in above said central portion (13) of above said second transverse strip (4), a lip (25) is cut out showing a folding line that coincides with above said folding line (5) between the first and second transverse strips (resp. 3 and 4) in order to be glued to this first transverse strip (3).

3. Broadsheet according to claim 1, characterized in that, in above said wings resulting in above said angular supports, formed by the strips (7–10), at the site of the folding line (11) shown substantially in the middle of the angular support between the strips (8 and 9), a portion (32) is provided which protrudes upwards when the box is ready for use.

4. Broadsheet according to claim 3, characterised in that, in the corners of the bottom (1) of the box, eacht time a space (31) is provided for receiving, upon stacking of two boxes, above said upwards pointing protruding portion (30).

5. Broadsheet according to claim 1, characterized in that the side walls of the box, which are linked foldably to the bottom (1) thereof and extend perpendicularly with respect to above said first and second transverse strips, consist of two longitudinal strips (18 and 19) to be glued together, the longitudinal edges of one of the longitudinal strips being glued onto the bottom (1) of the box.

6. Stackable cardboard box created by using the broadsheet according to claim 1.

* * * * *